US006087787A

United States Patent [19]

Williams

[11] Patent Number: 6,087,787

[45] Date of Patent: Jul. 11, 2000

[54] FLUORESCENT-LAMP EXCITATION CIRCUIT WITH FREQUENCY AND AMPLITUDE CONTROL AND METHODS FOR USING SAME

[75] Inventor: James M. Williams, Palo Alto, Calif.

[73] Assignee: Linear Technology Corporation, Milpitas, Calif.

[21] Appl. No.: 09/198,193

[22] Filed: Nov. 23, 1998

[51] Int. Cl.[7] ..... G05F 1/00

[52] U.S. Cl. ..... 315/307; 315/209 R; 315/224

[58] Field of Search ..... 315/209 R, 209 P, 315/224, 289, 291, 297, 307, 308, DIG. 5, DIG. 7

[56] References Cited

U.S. PATENT DOCUMENTS

| | | | |
|---|---|---|---|
| 4,851,739 | 7/1989 | Nilssen | 315/278 |
| 5,313,142 | 5/1994 | Wong | 315/205 |
| 5,548,189 | 8/1996 | Williams | 315/224 |
| 5,623,188 | 4/1997 | Bildgen | 315/307 |
| 5,648,702 | 7/1997 | Choi et al. | 315/224 |
| 5,929,718 | 7/1999 | Crosby | 333/24 |

*Primary Examiner*—Don Wong
*Assistant Examiner*—Tuyet T. Vo
*Attorney, Agent, or Firm*—Fish & Neave; Steven J. Cahill

[57] ABSTRACT

A power-supply and control circuit is provided for driving a fluorescent lamp from a low-voltage direct current (DC) power source such as a battery. The circuit includes a converter that converts low-voltage DC to high voltage alternating current (AC). The converter includes a feedback ceramic step-up transformer that amplifies the AC signal to a level sufficient to illuminate the lamp, and also provides a feedback signal that can be used to monitor the resonance frequency of the transformer. The power supply and control circuit also includes a first feedback loop that regulates the lamp current amplitude and a second feedback loop that forces the converter to operate at the transformer's resonant frequency.

24 Claims, 10 Drawing Sheets

LOW VOLTAGE SOURCE
CONTROL CIRCUIT
FEEDBACK TRANSFORMER
DRIVER
SYNCHRONIZED OSCILLATOR
LAMP
AFB
FFB
$V_1$
$V_2$
$V_3$
$V_{FB}$
$I_{LAMP}$
$VIP_1$
$VIP_2$
12
18
20
42
44
46
48
50
52$_1$
52$_2$
54$_1$
54$_2$
56
58
60
62
64
66
68
69
70
72
74
76
78
80
82
84
86
88
90
92
94
96
98
100
102

LOW VOLTAGE SOURCE
CONTROL CIRCUIT
FEEDBACK TRANSFORMER
LAMP
DRIVER
SYNCHRONIZED OSCILLATOR
$I_{LAMP}$
$V_{FB}$
$V_{DRIVE}$
$VIP_1$
$VIP_2$
AFB
FFB
12
18
20
42
44
46
48
52₁
52₂
54₁
54₂
56
58
60
62
64
66
68
69
72
74
76
78
80
82
84
86
88
92
94
96
98
100
102
110
114
116
118
120
122
124
126
128

300
344
346
20
94
92
102
98
96
100
364
$I_{LAMP}$
18
LAMP
356
$V_3$
48
FEEDBACK TRANSFORMER
$V_{FB}$
360
$354_1$
+
$V_2$
−
$354_2$
316
POWER STAGE
322
314
AMPLIFIER
$352_1$
$352_2$
$V_{BIAS}$
320
358
318
BANDPASS FILTER
$V_{FILT}$
+
$V_1$
−
VOLTAGE REGULATOR
AFB
342
LOW VOLTAGE SOURCE
312

FLUORESCENT-LAMP EXCITATION CIRCUIT WITH FREQUENCY AND AMPLITUDE CONTROL AND METHODS FOR USING SAME

BACKGROUND OF THE INVENTION

This invention relates to drive circuits for fluorescent lamps. More particularly, this invention relates to fluorescent lamp power supply circuits that use a first feedback loop to regulate lamp current amplitude and a second feedback loop to synchronize direct current-to-alternating current converter circuitry with the resonant frequency of a ceramic step-up transformer with isolated voltage feedback.

Fluorescent lamps increasingly are being used to provide efficient and broad-area visible light. For example, portable computers, such as lap-top and notebook computers, use fluorescent lamps to back-light or side-light liquid crystal displays to improve the contrast or brightness of the display. Fluorescent lamps also have been used to illuminate automobile dashboards and may be used with battery-driven, emergency-exit lighting systems.

Fluorescent lamps are useful in these and other low-voltage applications because they are more efficient, and emit light over a broader area, than incandescent lamps. Particularly in applications requiring long battery life, such as portable computers, the increased efficiency of fluorescent lamps translates into extended battery life, reduced battery weight, or both.

In low-voltage applications such as those discussed above, a power supply and control circuit must be used to operate the fluorescent lamp. In many applications in which fluorescent lamps are used, a direct current (DC) source ranging from 3 to 20 volts provides power to operate the lamp. Fluorescent lamps, however, generally require alternating current (AC) voltage sources of about 1000 volts root-mean-square ($V_{RMS}$) to start, and over about 200 $V_{RMS}$ to efficiently maintain illumination. Fluorescent lamps operate most efficiently if driven by a low-distortion sine wave. Excitation frequencies for fluorescent lamps typically range from about 20 kHz to about 100 kHz. Accordingly, a DC-AC power-supply circuit is needed to convert the available low-voltage DC input to a high-voltage, high-frequency AC output needed to power the fluorescent lamp.

FIG. 1 shows a block diagram of a previously-known fluorescent lamp power supply circuit used to convert low-voltage DC to high-voltage, high-frequency AC. The circuit of FIG. 1 is described in more detail in U.S. Pat. No. 5,548,189 to Williams (the "'189 Patent"), which is incorporated in its entirety herein by reference (the '189 Patent and this application are commonly assigned). Lamp circuit 10 includes low-voltage DC source 12, voltage regulator 14, DC-AC converter 16, fluorescent lamp 18 and amplitude feedback circuit 20. Low-voltage DC source 12 provides power for circuit 10, and may be any source of DC power. For example, in the case of a portable computer such as a lap-top or notebook computer, DC source 12 may be a nickel-cadmium or nickel-hydride battery providing 3–5 volts. Alternatively, if lamp circuit 10 is used with an automobile dashboard, DC source 12 may be a 12–14 volt automobile battery and power supply.

DC source 12 supplies low-voltage DC to voltage regulator 14, which may be a linear or switching regulator. For maximum efficiency, a switching regulator can be used. The '189 Patent describes implementing voltage regulator 14 using the LT-1072 switching regulator manufactured by Linear Technology Corporation, Milpitas, Calif. Other devices, however, could be used.

Voltage regulator 14 provides regulated low-voltage DC output $V_{dc}$ to DC-AC converter 16. DC-AC converter 16 converts $V_{dc}$ to a high-voltage, high-frequency AC output $V_{AC}$ of sufficient magnitude to drive fluorescent lamp 18. The peak amplitude of $V_{AC}$ is approximately 50–200 times greater than the amplitude of $V_{dc}$. As described in the '189 Patent, fluorescent lamp 18 may be any type of fluorescent lamp. For example, in the case of lighting a display in a portable computer, fluorescent lamp 18 may be a cold- or hot-cathode fluorescent lamp.

Voltage regulator 14 and DC-AC converter 16 deliver high-voltage AC power to fluorescent lamp 18. Amplitude feedback circuit 20 generates feedback voltage AFB, which is proportional to fluorescent lamp current $I_{LAMP}$. This current-mode feedback controls the output of voltage regulator 14 as a function of the magnitude of current $I_{LAMP}$. The output of voltage regulator 14, in turn, controls the output of DC-AC converter 16. As a result, the magnitude of current $I_{LAMP}$ conducted by fluorescent lamp 18, and hence the intensity of light emitted by the lamp, is regulated to a substantially constant value.

By including fluorescent lamp 18 in a current-mode feedback loop with voltage regulator 14, the fluorescent lamp's current and light intensity are regulated and remain substantially constant despite changes in input power, lamp impedance or environmental factors. Lamp circuit 10 similarly compensates for variations in the output voltage of low-voltage DC source 12. These features extend the useful lifetime of a fluorescent lamp in some applications.

FIG. 2 shows a more detailed block diagram of previously known lamp circuit 10. In particular, converter 16 includes self-oscillating driver circuit 22 and ceramic step-up transformer 24. Self-oscillating driver circuit 22 chops the low-voltage DC signal $V_{dc}$ supplied by voltage regulator 14 to create a low-voltage, high-frequency square-wave AC signal $V_{ac}$ that is supplied to ceramic step-up transformer 24. Ceramic step-up transformer 24 operates as a highly frequency-selective, high gain step-up device, and transforms low-voltage, high-frequency AC signal $V_{ac}$ to high-voltage, high-frequency AC signal $V_{AC}$.

FIG. 3 provides a graph of impedance versus frequency for ceramic step-up transformer 24 having a resonant frequency $F_R$. In theory, ceramic step-up transformer 24 has zero impedance at resonant frequency $F_R$ and infinite impedance at non-resonant frequencies. Ceramic step-up transformer 24 actually has negligible impedance at resonance and high impedance at all other frequencies. Thus, as frequency is tuned towards resonant frequency $F_R$ from either direction, the impedance abruptly spikes down to its lowest value. The steep non-linear ramps on either side of the impedance spike are sometimes referred to as "skirts."

In particular, at resonance, the piezoelectric characteristics of ceramic step-up transformer 24 make the device a high gain, step-up device with negligible internal impedance. At frequencies other than resonant frequency $F_R$, ceramic step-up transformer 24 behaves like a high-impedance circuit (theoretically approximating an open circuit). At "skirt" frequencies, ceramic step-up transformer 24 has intermediate ranges of impedance.

Ceramic step-up transformer 24 therefore functions as a highly-selective narrow-range filter. As a result, the input to ceramic step-up transformer 24 need not be substantially sinusoidal. For example, if $V_{ac}$ is a square-wave at resonant frequency $F_R$, $V_{ac}$ may be expressed (in a Fourier series) as a sinusoid at frequency $F_R$, plus an infinite series of sinusoids at odd-order harmonics of frequency $F_R$. Ceramic step-up transformer 24 amplifies the sinusoidal component of $V_{ac}$ at $F_R$, and attenuates the higher-frequency harmonics. Thus, ceramic step-up transformer 24 advantageously generates a low-distortion, high-voltage, high-frequency sine wave $V_{AC}$ at resonant frequency $F_R$ to optimally drive fluorescent lamp 18.

Circuit components that comprise self-oscillating driver circuit 22 primarily determine the driver's oscillation frequency $f_{osc}$. Ideally, oscillation frequency fosc equals resonant frequency $F_R$. As a result of component tolerances, environmental conditions and aging of driver circuit 22 and ceramic step-up transformer 24, however, oscillation frequency $f_{osc}$ may vary from resonant frequency $F_R$ by as much as ±20%. If fosc is significantly off-resonance, lamp circuit 10 of FIG. 2 may not operate efficiently, or may even fail to operate altogether.

As shown in FIG. 6 of the '189 Patent, previously-known lamp circuits have addressed off-resonance operation as a means to control the amplitude of the lamp current. FIG. 4 shows a block diagram of one previously known lamp circuit that uses a frequency control loop to maintain stable operation both on-resonance and off-resonance. In particular, lamp circuit 40 includes low-voltage DC source 12, lamp 18, ceramic step-up transformer 24, operational amplifier (opamp) 30, voltage-controlled oscillator (VCO) 32 and driver 34.

Opamp 30 has a first input 26 coupled to voltage-control signal VC provided by low-voltage DC source 12, and a second input 28 coupled to feedback signal FB from lamp 18. As described below, VC controls the output frequency of VCO 32. Opamp 30 generates a DC-voltage signal that is proportional to the difference between feedback signal FB and voltage-control signal VC, and that sets the operating frequency of VCO 32. VCO 32 generates an AC signal that is amplified by driver 34. The output of driver 34 is coupled to the input of ceramic step-up transformer 24. Ceramic step-up transformer 24 outputs a stepped-up, sinusoidal voltage waveform to drive lamp 18. Feedback signal FB is proportional to lamp current $I_{LAMP}$, and is used to regulate the lamp drive.

Low-voltage DC source 12, opamp 30 and VCO 32 control the oscillation frequency of lamp circuit 40. By adjusting voltage-control signal VC, lamp circuit 40 can be directed to drive lamp 18 to resonant frequency $F_R$ of ceramic step-up transformer 24. In addition, control signal VC can be used to drive lamp 18 off-resonance, and therefore vary the magnitude of lamp current $I_{LAMP}$ and intensity of lamp 18.

The previously-known lamp circuit of FIG. 4 thus uses complex circuits to ensure that lamp circuit 40 can operate off-resonance without disabling the circuit or shutting down lamp 18. The circuit does not, however, provide a simple means to both control the amplitude of the lamp current and match the operating frequency of the driver to the resonant frequency of the ceramic step-up transformer.

In view of the foregoing, it would therefore be desirable to provide a ceramic step-up transformer lamp circuit and method that provides amplitude feedback control and frequency feedback control to regulate lamp current and oscillation frequency.

It further would be desirable to provide a ceramic step-up transformer lamp circuit and method that regulates lamp current and oscillation frequency with minimal complexity.

SUMMARY OF THE INVENTION

It is an object of this invention to provide a ceramic step-up transformer lamp circuit and method that provides amplitude feedback control and frequency feedback control to regulate lamp current and oscillation frequency.

It further is an object of this invention to provide a ceramic step-up transformer lamp circuit and method that regulates lamp current and oscillation frequency with minimal complexity.

These and other objects are accomplished in accordance with the principles of the present invention by fluorescent lamp power supply and control circuits that use a first feedback loop to regulate the amplitude of the lamp current and a second feedback loop to synchronize DC-AC converter circuitry with the resonant frequency of a ceramic step-up transformer with isolated voltage feedback (Feedback Transformer).

In particular, a DC source powers a regulator circuit coupled to a DC-to-AC converter, the output of which drives a fluorescent lamp. The DC-AC converter includes a Feedback Transformer that converts a low-voltage AC signal provided by a synchronized oscillating driver to a high-voltage sinusoidal AC signal sufficient to operate the fluorescent lamp. The Feedback Transformer provides a feedback signal that is a sinusoid at the transformer's resonant frequency. The DC-AC converter also includes a frequency feedback circuit that couples the feedback signal to the synchronized oscillating driver, and forces the driver to operate at the resonant frequency of the Feedback Transformer. In addition, a separate amplitude control loop regulates the amplitude of the lamp current to a substantially constant value, regardless of changes in operating conditions and lamp impedance.

BRIEF DESCRIPTION OF THE DRAWINGS

The above and other objects and advantages of the present invention will be apparent upon consideration of the following detailed description, taken in conjunction with accompanying drawings, in which like reference characters refer to like parts throughout, and in, which.

DETAILED DESCRIPTION OF THE INVENTION

Figure 1:
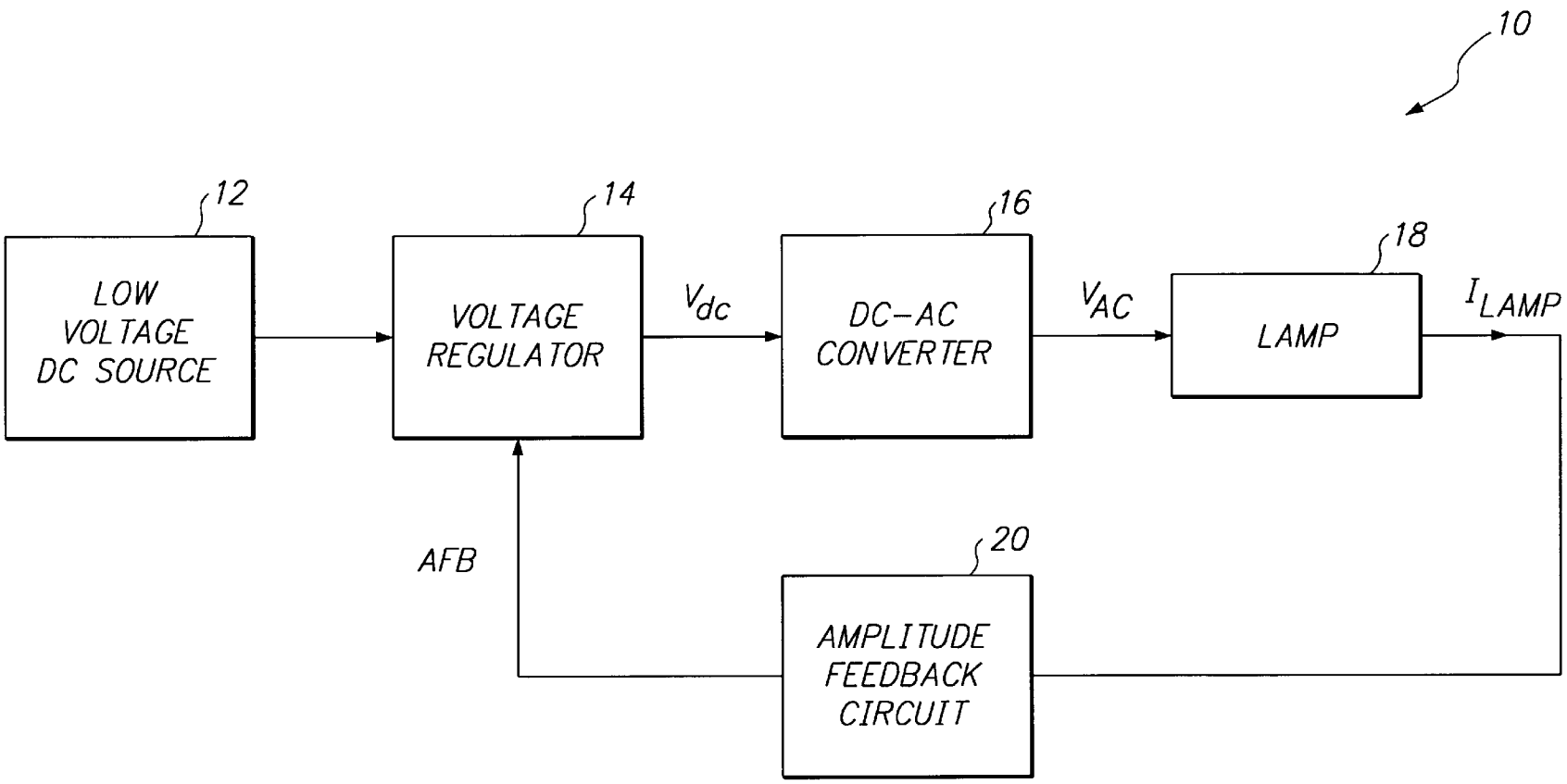
FIG. 1 (PRIOR ART)
FIG. 1 is a block diagram of a previously-known fluorescent-lamp power-supply and control circuit.
Figure 2:
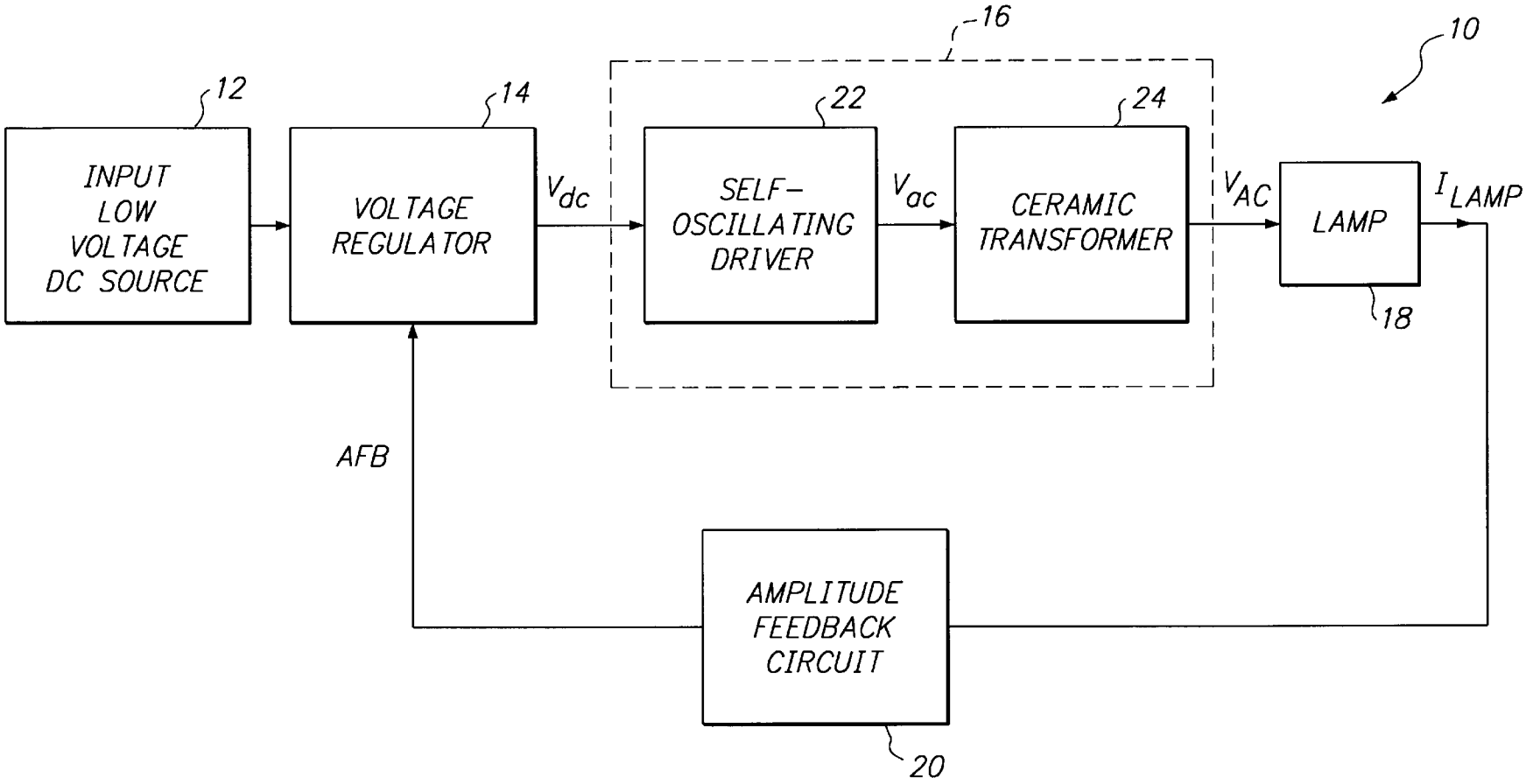
FIG. 2 (PRIOR ART)
FIG. 2 is a more detailed block diagram of the fluorescent-lamp power-supply and control circuit of FIG. 1.
Figure 3:
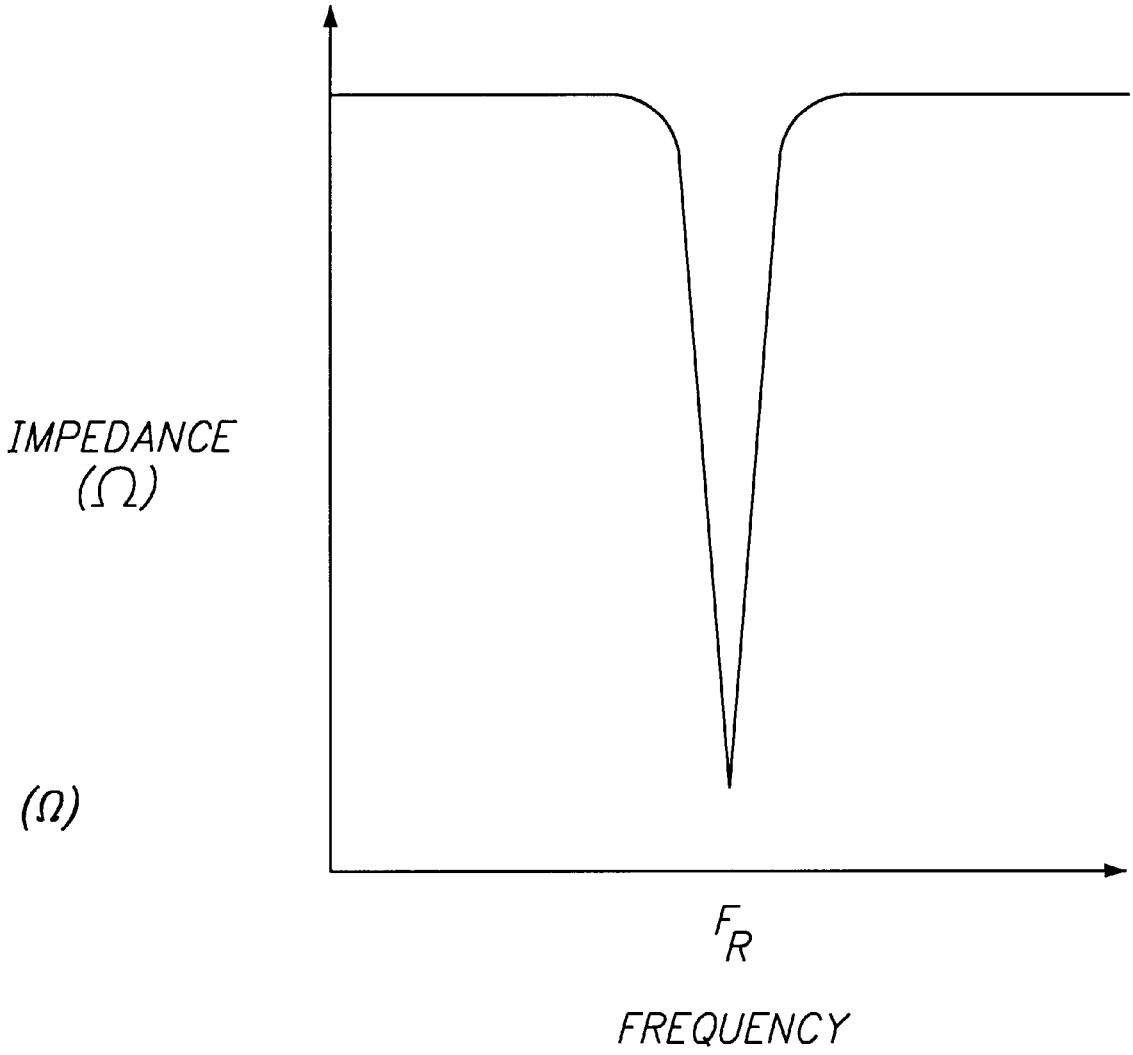
FIG. 3 is a schematic diagram of impedance as a function of frequency of the ceramic step-up transformer of FIG. 2.
Figure 4:
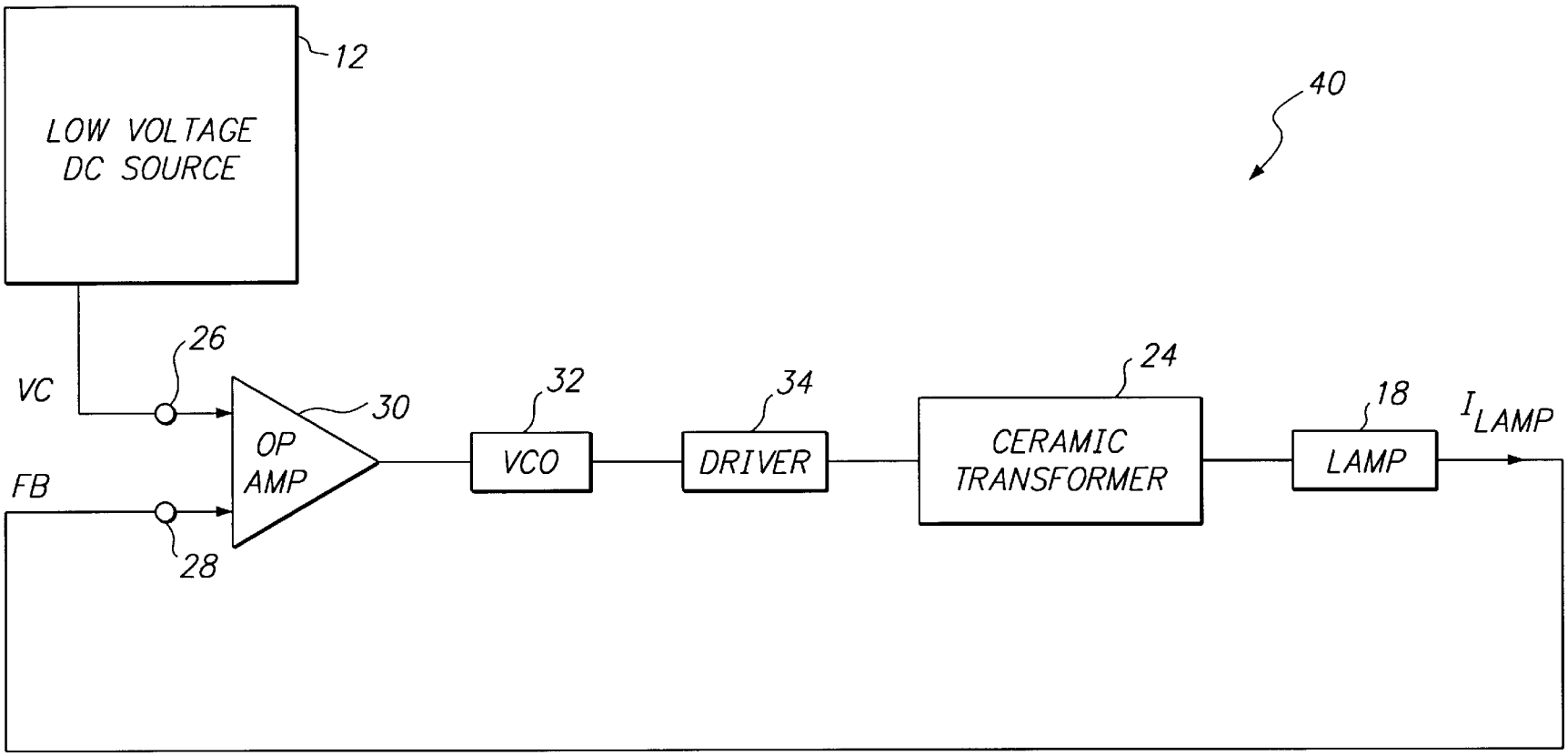
FIG. 4 (PRIOR ART)
FIG. 4 is a block diagram of another previously-known fluorescent-lamp power-supply and control circuit.
Figure 5:
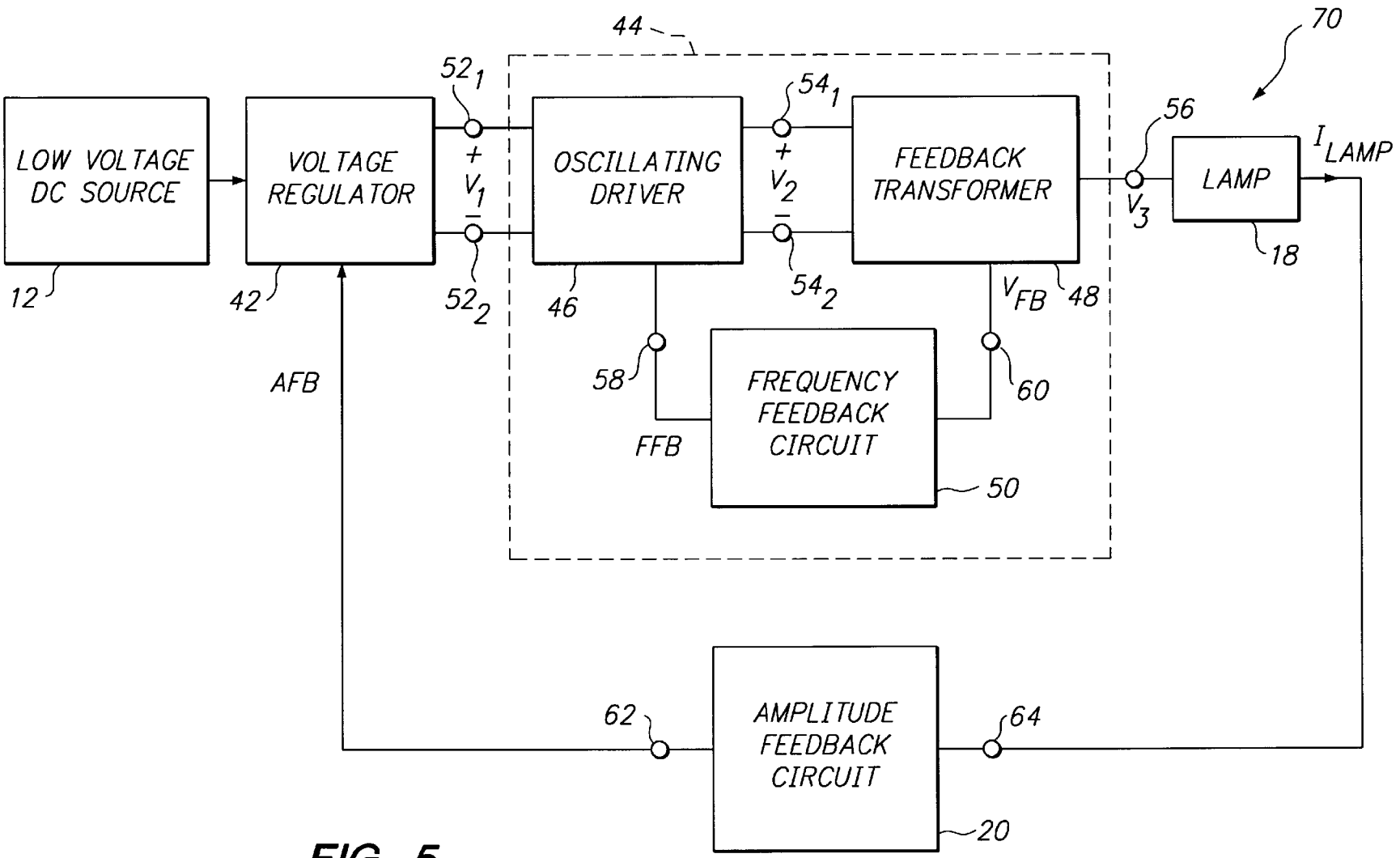
FIG. 5 is a block diagram of a dual-loop fluorescent-lamp power-supply and control circuit that incorporates principles of the present invention.

FIG. 5 is an illustrative embodiment of a lamp circuit of the present invention. Lamp circuit 70 includes low-voltage DC source 12, voltage regulator 42, DC-AC converter 44, lamp 18 and amplitude feedback circuit 20. Voltage regulator 42 can include any of a number of commercially available linear or switching regulators. For example, voltage regulator 42 may be implemented using the LT-1375 switching regulator manufactured by Linear Technology Corporation, Milpitas, Calif. As in prior art lamp circuit 10, voltage regulator 42 provides a regulated low-voltage DC output $V_1$ to DC-AC converter 44, which converts $V_1$ to a high-voltage, high-frequency AC output $V_3$ sufficient to drive fluorescent lamp 18. Unlike lamp circuit 10, however, lamp circuit 70 provides both frequency feedback control and amplitude feedback control.

Amplitude feedback control is described in more detail below. Frequency feedback control is provided by DC-AC converter circuit 44, which includes oscillating driver 46, Feedback Transformer 48 and frequency feedback circuit 50. oscillating driver 46 has first and second inputs coupled at terminals $\mathbf{52}_1$ and $\mathbf{52}_2$ to outputs of voltage regulator 42, first and second outputs coupled at terminals $\mathbf{54}_1$ and $\mathbf{54}_2$ to inputs of Feedback Transformer 48, and a third input coupled at terminal 58 to an output FFB of frequency feedback circuit 50. Oscillating driver 46 converts a low-voltage DC signal $V_1$ between terminals $\mathbf{52}_1$ and $\mathbf{52}_2$ to a low-voltage AC signal $V_2$ between input terminals $\mathbf{54}_1$ and $\mathbf{54}_2$. $V_2$ is synchronized to the frequency of output FFB at terminal 58.

Feedback Transformer 48 provides an output signal $V_3$ coupled at terminal 56 to lamp 18, and a frequency feedback output $V_{FB}$ coupled at voltage feedback terminal 60 to an input of frequency feedback circuit 50. If $V_2$ is an AC signal at resonant frequency $F_R$, Feedback Transformer 48 generates at output terminal 56 a high-voltage output signal $V_3$ at resonant frequency $F_R$, and generates at voltage feedback terminal 60 frequency feedback output $V_{FB}$, which is an AC signal at resonant frequency $F_R$ that is independent of any changes in loading at output terminal 56. The input-to-output voltage gain G of Feedback Transformer 48 is given by:

$$G = \frac{V_3}{V_2}$$

Feedback Transformer 48 is described in more detail below.

Frequency feedback circuit 50 provides an AC output FFB that is proportional to frequency feedback output $V_{FB}$. FFB is coupled to the third input of oscillating driver 46 at terminal 58 to synchronize oscillating driver 46 to resonant frequency $F_R$ of Feedback Transformer 48. These connections close a frequency control loop that regulates the operating frequency of lamp circuit 70. Thus, if the resonant frequency of Feedback Transformer 48 changes to $F_R$ as a result of aging, temperature or operating conditions, the frequency of $V_{FB}$ and FFB also change to $F_R$, causing the output of oscillating driver 46 to track the resonant frequency of Feedback Transformer 48.

Figure 6A:
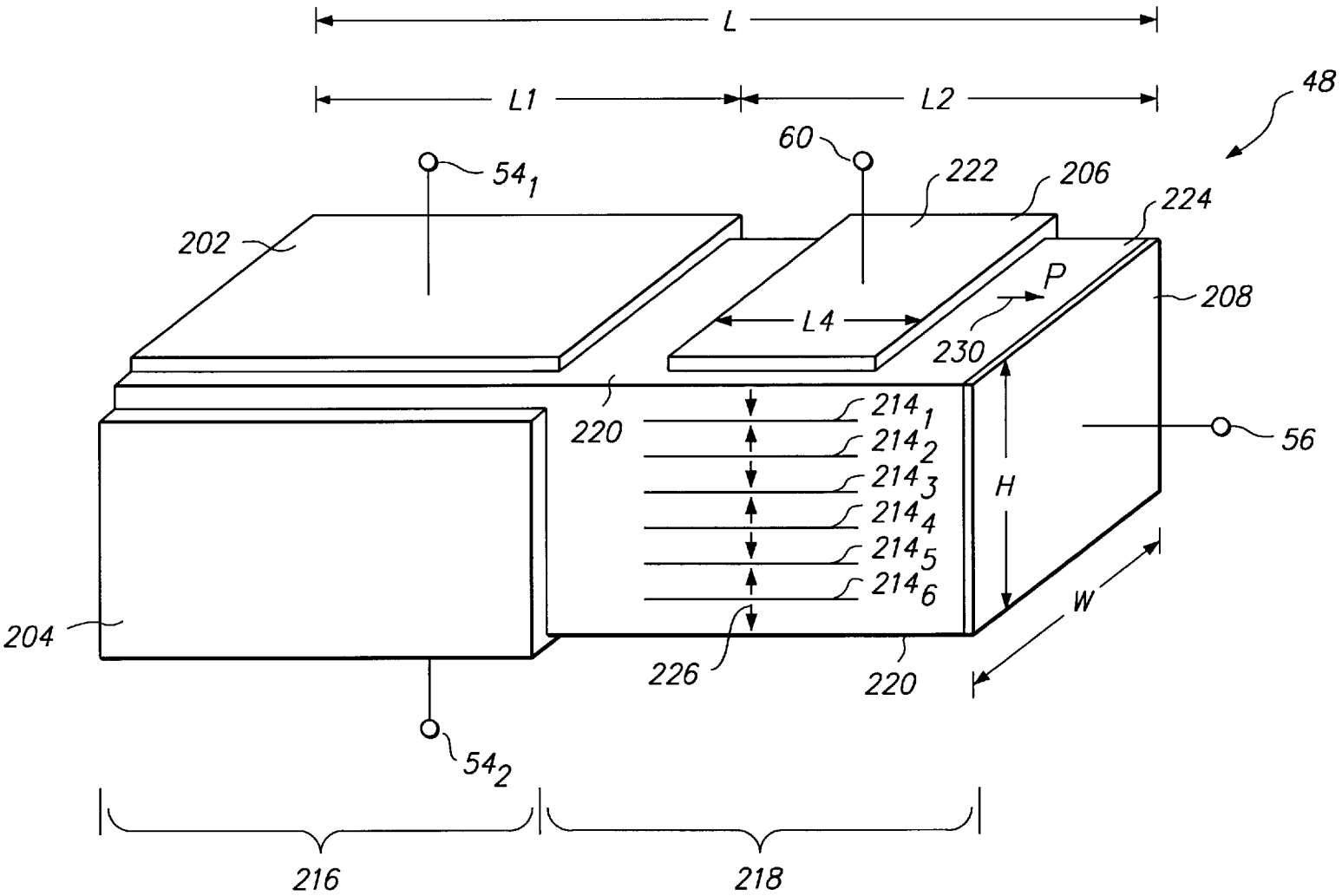
FIGS. 6A and 6B are schematic diagrams of an embodiment of the Feedback Transformer of FIG. 5.
Figure 6B:
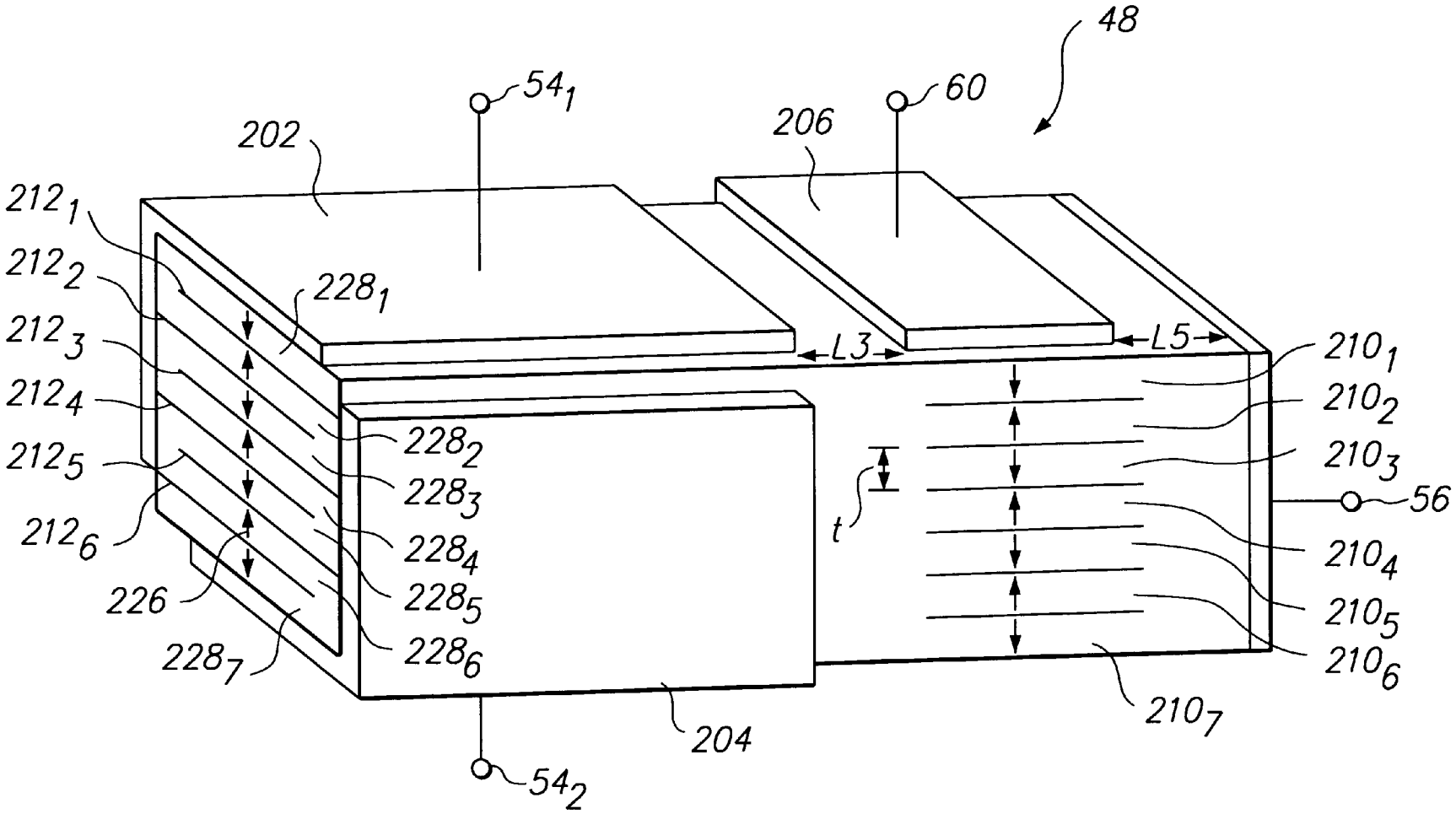

FIGS. 6A and 6B show an illustrative Feedback Transformer used in conjunction with lamp circuits of the present invention. Feedback Transformer 48 is comprised of piezoelectric plate 200, first input electrode 202, second input electrode 204, feedback electrode 206 and output electrode 208. Input terminals $\mathbf{54}_1$ and $\mathbf{54}_2$ are connected to first and second input electrodes 202 and 204, respectively. Voltage feedback terminal 60 and output terminal 56 are connected to feedback electrode 206 and output electrode 208, respectively.

Piezoelectric plate 200 includes driving section 216 and driven section 218. Driven section 218 includes unpolarized dielectric section 220, voltage feedback section 222 and normally polarized dielectric section 224. Unpolarized dielectric section 220 is adjacent to driving section 216, and voltage feedback section 222 is located between unpolarized dielectric section 220 and normally polarized dielectric section 224.

Driving section 216 contains a plurality of layers 228 of green ceramic tape, and a plurality of electrodes 212 that lie between the layers 228 of ceramic tape. Each of layers 228 have a thickness t. Similarly, driven section 218 contains a plurality of layers 210 of green ceramic tape, and a plurality of electrodes 214 that lie between the layers 210 of ceramic tape. Each of layers 210 have a thickness t.

Electrodes 212 and 214 may be, among other things, silver or silver palladium. Although 7 layers 210 and 228 are shown in FIGS. 6A and 6B the number of layers N may be lower or higher than 7. As described in more detail below, the open-circuit gain G of Feedback Transformer 48 is proportional to N.

Layers 210 and 228 and electrodes 212 and 214 are stacked and heated under applied pressure to form a stacked ceramic transformer. First input electrode 202 is formed on a top surface and a back surface (not shown) of piezoelectric plate 200. Second input electrode 204 is formed on a front surface and a bottom surface of piezoelectric plate 200. Feedback electrode 206 is formed on the top surface and the back surface (not shown) of piezoelectric plate 200. Output electrode 208 is formed on a first end surface of piezoelectric plate 200. As shown in FIG. 6B, first input electrode 202 connects in common electrodes $\mathbf{212}_2$, $\mathbf{212}_4$ and $\mathbf{212}_6$, and second input electrode 204 connects in common electrodes $\mathbf{212}_1$, $\mathbf{212}_3$ and $\mathbf{212}_5$. Similarly, feedback electrode connects in common electrodes $\mathbf{214}_1$–$\mathbf{214}_6$.

Layers 210 and 228 are polarized in the direction of the thickness of piezoelectric plate 200, as shown by arrows 226. Normally polarized dielectric section 224 is polarized in a direction normal to the thickness direction, as shown by arrow 230.

Feedback Transformer 48 has a length L, width W, and height H. Driving section 216 and driven section 218 have lengths $L_1$ and $L_2$, respectively, that each are approximately one-half the length L. Unpolarized dielectric section 220 has a length $L_3$ that is sufficiently large to minimize capacitive coupling between driving section 216 and voltage feedback section 222. In particular, length $L_3$ is about four times greater than the thickness t of dielectric tape that forms piezoelectric plate 200. Voltage feedback section 222 has a length $L_4$ that is approximately onehalf the length $L_2$. Normally polarized dielectric section 224 has a predetermined length $L_5$ whose value is proportional to the open-circuit gain of Feedback Transformer 48, as described below. To eliminate spurious vibrations in Feedback Transformer 48, width W should be less than about one-fourth the length L. The height H is equal to N*t, and has a value that typically is determined by size constraints for the application in which the lamp circuit will be used. Height H is on the order of about 0.1 inches.

If AC voltage $V_2$ is applied between input terminals $\mathbf{54}_1$ and $\mathbf{54}_2$, driving section 216 generates a piezoelectric vibration. Unpolarized dielectric section 220 transmits the piezoelectric vibration from driving section 216 to voltage feedback section 222 and normally polarized dielectric section 224. As a result, normally polarized dielectric section 224 generates output signal $V_3$ at output terminal 56 and voltage feedback section 222 generates frequency feedback output $V_{FB}$ at voltage feedback terminal 60. $V_{FB}$ is isolated from $V_{OUT}$.

The open-circuit gain G of Feedback Transformer 48 may be expressed as:

$$G \propto \frac{N * L_5}{t}$$

Where Ls is the length of output section 224, N is the number of layers 210 and t is the thickness of each layer. Thus, if the desired open-circuit gain G, number of layers N and thickness t are known, the length $L_5$ of normally polarized dielectric section 224 may be determined.

Figure 7:
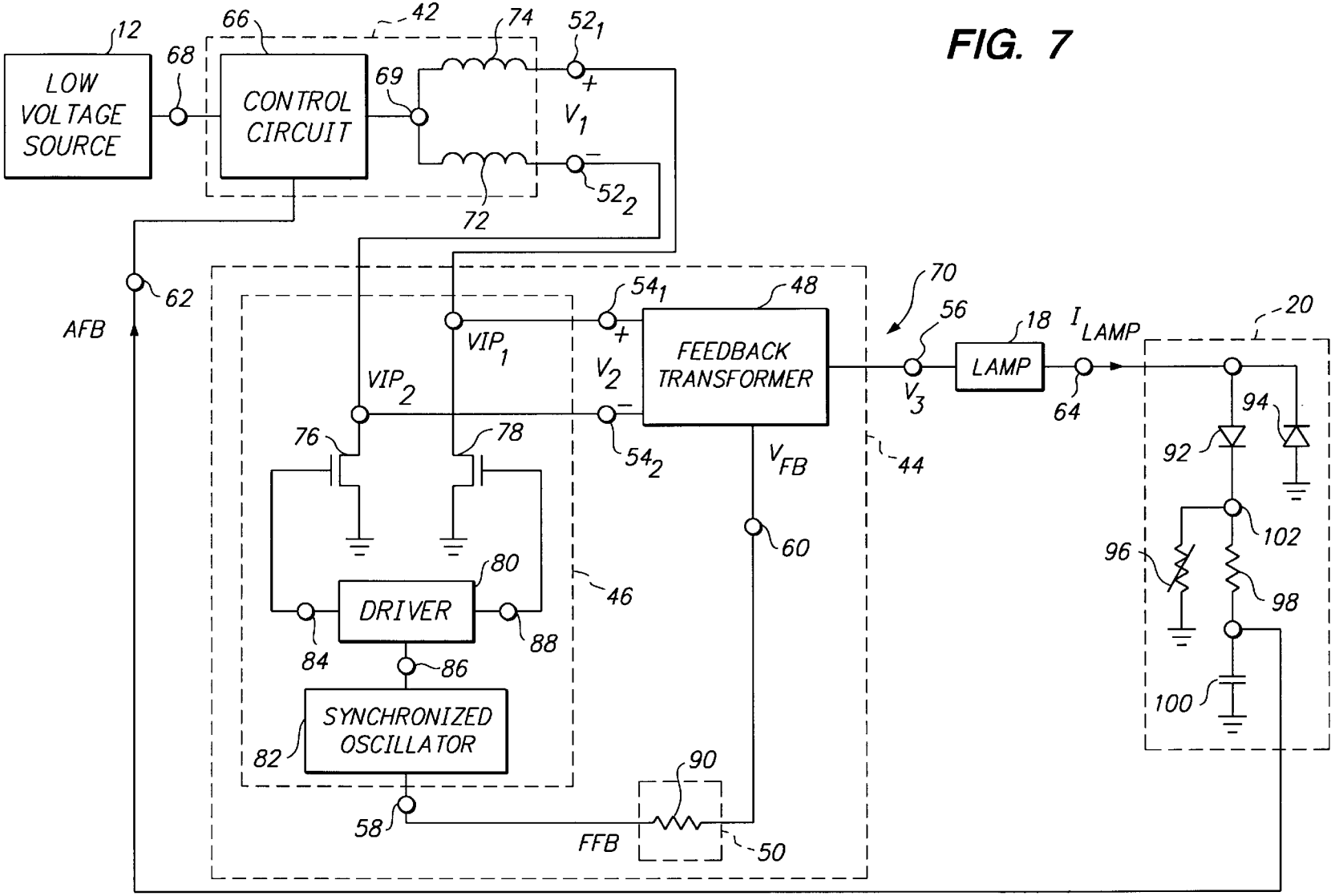
FIG. 7 is a schematic block diagram of an illustrative embodiment of the dual-loop fluorescent-lamp power-supply and control circuit of FIG. 5.

FIG. 7 illustrates a more detailed schematic diagram of the illustrative lamp circuit of FIG. 5. Voltage regulator 42 includes control circuit 66 (such as the LT-1375) and output inductors 72 and 74. When implemented using an LT-1375, control circuit 66 includes feedback terminal 62, power terminal 68 and output terminal 69. Inductors 72 and 74 are coupled between output terminal 69 and terminals $\mathbf{52}_1$ and $\mathbf{52}_2$ respectively.

Oscillating driver 46 includes transistors 76 and 78, driver 80 and synchronized oscillator 82. Oscillating driver 46 converts DC signals at terminals $\mathbf{52}_1$ and $\mathbf{52}_2$ to a pair of low-voltage approximately square-wave signals. In particular, control circuit 66 and inductors 72 and 74 generate a DC voltage $V_1$ between terminals $\mathbf{52}_1$ and $\mathbf{52}_2$. Driver 80 switches transistors 76 and 78 ON and OFF at a frequency set by synchronized oscillator 82. As a result, transistors 76 and 78 "chop" the signals at terminals $\mathbf{52}_1$ and $\mathbf{52}_2$ between $V_1$ and GROUND to produce approximately square-wave waveforms at terminals $\mathbf{54}_1$ and $\mathbf{54}_2$ that are 180° out of phase from one another.

Driver 80 can be any conventional complementary metal oxide semiconductor (CMOS) driver circuit, such as a pair of parallel invertors, that can drive the gates of transistors 76 and 78. Synchronized oscillator 82 may be any conventional oscillator, such as a three-invertor CMOS oscillator, designed to operate at the nominal resonant frequency $F_R$ of Feedback Transformer 48, but that can be synchronized to a signal applied to the third input of oscillating driver 46 coupled to terminal 58.

Resistor 90 forms frequency feedback circuit 50, and provides frequency feedback signal FFB at terminal 58. Synchronized oscillator 82, therefore, generates a clock signal at terminal 86 having a frequency synchronized with frequency feedback signal FFB. As a result, driver 80 and transistors 76 and 78 generate AC signals at terminals $\mathbf{54}_1$ and $\mathbf{54}_2$ synchronized with resonant frequency $F_R$ of Feedback Transformer 48.

Amplitude feedback control is provided by an amplitude feedback loop including lamp 18 and amplitude feedback circuit 20. Amplitude feedback circuit 20 includes diodes 92 and 94, variable resistor 96, resistor 98 and capacitor 100. Diodes 92 and 94 half-wave rectify lamp current $I_{LAMP}$. Diode 94 shunts negative portions of each cycle of $I_{LAMP}$ to GROUND, and diode 92 conducts positive portions of $I_{LAMP}$.

Resistor 98 and capacitor 100, coupled in series between terminal 102 and GROUND, form a low-pass filter that produces a voltage AFB proportional to the magnitude of $I_{LAMP}$. $I_{LAMP}$ is a sinusoid, and therefore AFB is a low-pass filtered, half-wave rectified sinusoid. AFB is coupled at terminal 62 to the feedback terminal of control circuit 66. The above connections close the amplitude feedback control loop that regulates the amplitude of current $I_{LAMP}$. Variable resistor 96, connected in parallel with resistor 98 and capacitor 100, permit DC adjustment of voltage AFB.

Upon start-up of circuit 70, voltage AFB on feedback terminal 62 is generally below the internal reference voltage of control circuit 66 (e.g., 2.42 volts for the LT-1375). Thus, control circuit 66 supplies maximum power at output terminal 69. As a result, either inductor 72 or 74 (as controlled by transistors 76 and 78) conducts current. Synchronized oscillator 82 operates at the nominal resonant frequency $F_R$ of Feedback Transformer 48.

If synchronized oscillator 82 operates at the resonant frequency of Feedback Transformer 48, Feedback Transformer 48 generates a high-frequency, high-voltage output to ignite lamp 18. If, however, synchronized oscillator 82 starts off-resonance (e.g., at a frequency $F_R' \neq F_R$ as a result of oscillator error), Feedback Transformer 48 generates an output at frequency $F_R$, but of insufficient amplitude to ignite lamp 18.

Feedback Transformer 48 generates frequency feedback output $V_{FB}$ at frequency $F_R$ that is coupled by resistor 90 to the third input of oscillating driver 46 at terminal 58. Resistor 90 has a very large value (e.g., 1–10 MΩ), much larger than input resistance of synchronized oscillator 82 (e.g., 10–100 KQ). As a result, the signal at terminal 58 is approximately 40dB below $V_{FB}$ (i.e., $0.01*V_{FB}$). Even if synchronized oscillator 82 starts off-resonance (e.g., by ±20%), $V_{FB}$ and FFB have sufficiently large amplitudes (e.g., 125–500 and 1.25–5 volts peak-to-peak, respectively) that synchronized oscillator 82 can lock onto the transformer's resonant frequency $F_R$. As a result, oscillating driver 46 generates AC signal $V_2$ between terminals $\mathbf{54}_1$ and $\mathbf{54}_2$ synchronized to the resonant frequency of Feedback Transformer 48. In turn, Feedback Transformer 48 generates AC output signal $V_3$ sufficient to illuminate lamp 18.

The amplitude feedback loop forces voltage regulator 42 to modulate the output of DC-AC converter 44 to whatever value is required to maintain a constant current in lamp 18. The magnitude of that constant current can, however, be varied by variable resistor 96. Because the intensity of lamp 18 is directly related to the magnitude of lamp current $I_{LAMP}$, variable resistor 96 thus allows the intensity of lamp 18 to be adjusted smoothly and continuously over a chosen range of intensities.

Figure 8:
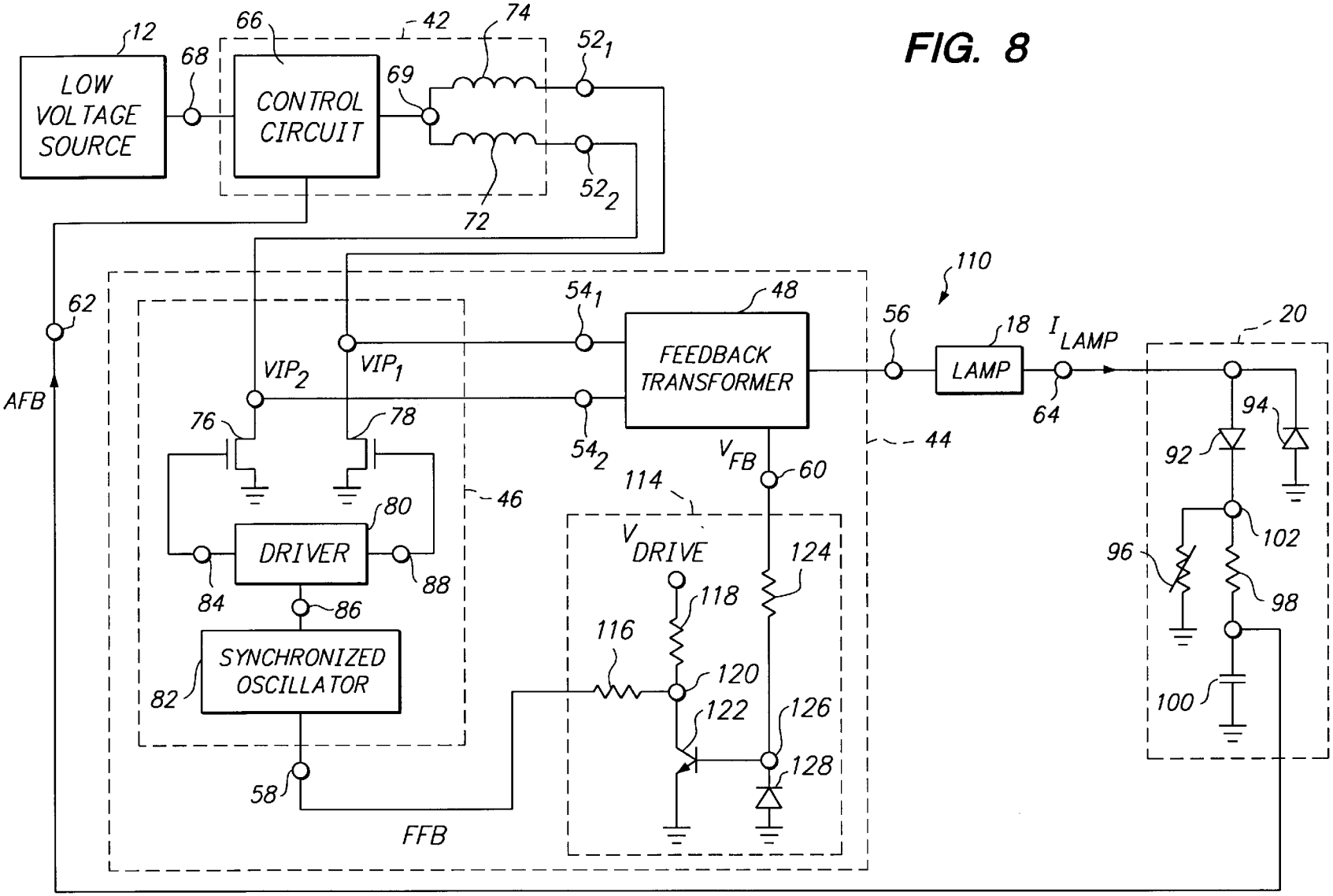
FIG. 8 is a schematic block diagram of another illustrative embodiment of the dual-loop fluorescent-lamp power-supply and control circuit of FIG. 5.

The amplitude of frequency feedback output $V_{FB}$ is proportional to the amplitude of $I_{LAMP}$. In particular, if $I_{LAMP}$ increases, $V_{FB}$ and FFB increase, and if $I_{LAMP}$ decreases, $V_{FB}$ and FFB decrease. If $I_{LAMP}$ is low, synchronized oscillator 82 must lock onto a very low amplitude signal. To eliminate the dependence of the amplitude of FFB on the amplitude of $I_{LAMP}$, lamp circuit 70 may be modified as shown in FIG. 8. Lamp circuit 110 is identical to lamp circuit 70, except that frequency feedback circuit 50 has been replaced with enhanced frequency feedback circuit 114 that normalizes the amplitude of frequency feedback signal FFB independent of the amplitude of frequency feedback output $V_{FB}$.

Enhanced frequency feedback circuit 114 includes resistors 116, 118 and 124, bipolar transistor 122 diode 128 and voltage source $V_{DRIVE}$. Resistor 116 is coupled between the third input of oscillating driver 46 at terminal 58 and the collector of bipolar transistor 122 at terminal 120. Bipolar transistor 122 has its collector coupled to $V_{DRIVE}$ through current limiting resistor 118 its base coupled at terminal 126 to frequency feedback output VF, through current limiting resistor 124, and its emitter coupled to GROUND. Diode 128 has an anode end coupled to GROUND and a cathode end coupled to the base of transistor 122 at terminal 126 $V_{DRIVE}$ is a DC voltage source having a logic HIGH potential (e.g., +5 volts).

Diode 128 half-wave rectifies frequency feedback output $V_{FB}$ by shunting negative portions of each cycle of $V_{FB}$ to GROUND. The rectified signal is coupled to the base of transistor 122 Transistor 122 amplifies the rectified signal $V_{FB}$, and generates an output at terminal 120 that switches between HIGH and GROUND, at the resonant frequency of Feedback Transformer 48. Resistor 116 couples the amplified signal to the third input at terminal 58. The gain of transistor 122 allows switching of frequency feedback signal FFB between HIGH and GROUND despite variations in the amplitude of $I_{LAMP}$ and frequency feedback output $V_{FB}$.

Figure 9:
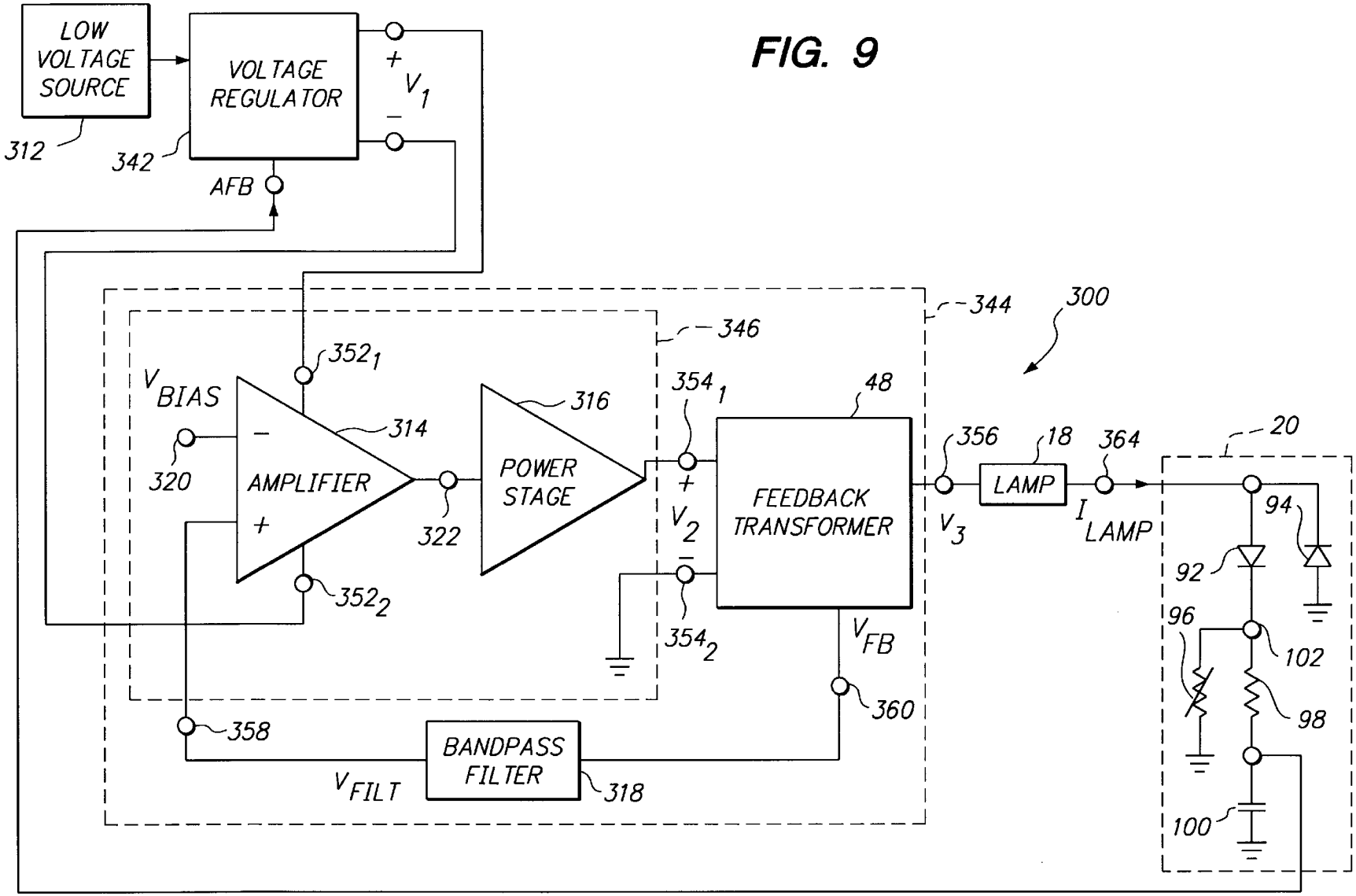
FIG. 9 is a schematic block diagram of another illustrative embodiment of a dual-loop fluorescent-lamp power-supply and control circuit that incorporates principles of the present invention.

FIG. 9 illustrates another illustrative embodiment of a lamp circuit of the present invention. Lamp circuit 300 includes low-voltage DC source 312 voltage regulator 342 amplifier 314 power stage 316 feedback transformer 48, bandpass filter 318 lamp 18, amplitude feedback circuit 20 and DC voltage source $V_{BIAS}$. DC source 312 supplies low-voltage DC (typically 12V) to voltage regulator 342 which can include any of a number of commercially available linear or switching regulators. For example, voltage regulator 342 may be implemented using the LT-1375 switching regulator. Voltage regulator 342 provides a regulated DC output $V_1$ (typically 5V) between terminals $\mathbf{352}_1$ and $\mathbf{352}_2$.

Amplifier 314 power stage 316 and voltage source $V_{BIAS}$ form an oscillating driver 346 that provides a high-voltage output signal $V_2$ between terminals $\mathbf{354}_1$ and $\mathbf{354}_2$ at frequency $F_R$ to drive lamp 18. Amplifier 314 can be a high gain comparator, such as the LT1011 comparator, or a wideband amplifier, such as the LT1122, both manufactured by Linear Technology Corporation, Milpitas, Calif.

Amplifier 314 has power supply terminals 352 and $\mathbf{352}_2$, output terminal 322, inverting input terminal 320 and non-inverting input terminal 358 The output $V_1$ of regulator 342 supplies power to amplifier 314 Inverting input terminal 320 is coupled to DC voltage $V_{BIAS}$ (typically 1V), and non-inverting input terminal 358 is coupled to the output VFILT of bandpass filter 318 Amplifier 314 has high input impedance and low output impedance, and provides an AC output signal at terminal 322 (typically 5 Vp-p) at approximately 1–10 mW. To provide adequate power to drive the inputs of feedback transformer 48, power stage 316 includes a current gain stage to provide an AC output signal (typically 5Vp-p) at approximately 1–10 W between terminals $\mathbf{354}_1$ and $\mathbf{354}_2$.

Feedback transformer 48 provides an output signal $V_3$ at terminal 356 and a frequency feedback output $V_{FB}$. $V_{FB}$ has significant amplitude and phase components at frequencies other than the desired operating frequency $F_R$. Lamp circuit 300 includes bandpass filter 318 which has a passband centered at $F_R$, and provides approximately 20 dB attenuation (relative to the passband) at frequencies less than $0.5*F_R$ and greater than $2*F_R$. Bandpass filter 318 may be any conventional bandpass filter comprising discrete resistors and capacitors (e.g., a twin-T filter), although the filter also may include active monolithic integrated circuits.

Because $V_{FB}$ typically may be on the order of 50 Vrms, the components of bandpass filter 318 must be capable of handling such large voltage levels. Further, to match the input signal range of amplifier 314 bandpass filter 318 should provide sufficient passband attenuation (e.g., –28 dB) so that output voltage $V_{FILT}$ is approximately 2 Vrms at frequency $F_R$.

On startup of circuit 300 circuit noise or some other suitable startup signal causes frequency feedback output $V_{FB}$ to generate a signal having many frequency components, including a component at the desired resonant frequency $F_R$ of feedback transformer 48. Bandpass filter 318 provides output $V_{FILT}$ having a substantially dominant component at frequency $F_R$ at terminal 358. As a result, amplifier 314 and power stage 316 generate an AC signal between terminals $\mathbf{354}_1$ and $\mathbf{354}_2$ synchronized to resonant frequency $F_R$ of Feedback Transformer 48. In turn, Feedback Transformer 48 generates AC output signal at terminal 356 sufficient to illuminate lamp 18.

Persons of ordinary skill in the art will recognize that the power-supply and control circuit of the present invention can be implemented using circuit configurations other than those shown and discussed above. All such modifications are within the scope of the present invention, which is limited only by the claims that follow.

I claim:

1. A method for operating a fluorescent lamp using a direct current (DC) power source and a ceramic step-up transformer having first and second inputs, first and second outputs, and a resonant frequency, the first output of the ceramic transformer coupled to a fluorescent lamp, the second output of the ceramic transformer providing a voltage feedback signal isolated from the first output, the lamp conducting a current, the method comprising:

generating an amplitude feedback signal proportional to the lamp current;

regulating a DC voltage from the DC power source;

converting the regulated DC voltage to an AC signal;

supplying the AC signal to the first and second inputs of the ceramic transformer;

sensing the voltage feedback signal to synchronize the frequency of the AC signal to the resonant frequency; and controlling the regulated DC voltage based on the amplitude feedback signal.

2. The method of claim 1, wherein:

the converting step comprises generating first and second squarewave signals at the first frequency, the squarewave signals 180° out of phase from one another;

the synchronizing step comprises adjusting the first frequency to match the resonant frequency.

3. The method of claim 1, wherein the sensing step further comprises sensing the resonant frequency independent of the amplitude of the lamp current.

4. The method of claim 1, wherein the converting step comprises:

bandpass filtering the voltage feedback signal to provide a filtered feedback signal;

generating the AC signal by amplifying the difference between the filtered feedback signal and a DC reference signal.

5. A fluorescent lamp circuit for use with a direct current (DC) power source and a ceramic step-up transformer having first and second inputs, first and second outputs, and a resonant frequency, the first output of the ceramic transformer coupled to a fluorescent lamp, the second output of the ceramic transformer providing voltage feedback isolated from the first output, the lamp circuit comprising:

a voltage regulator coupled to the DC power source;

an oscillating driver coupled to the voltage regulator and the first and second inputs of the ceramic transformer;

a frequency feedback circuit coupled to the oscillating driver and the second output of the ceramic transformer; and an amplitude feedback circuit coupled to the lamp and the voltage regulator.

6. The lamp circuit of claim 5, wherein the frequency feedback circuit comprises a resistor.

7. The lamp circuit of claim 5, wherein the frequency feedback circuit comprises:

a half-wave rectifier having an input coupled to the second output of the ceramic transformer, and an output; and an inverting amplifier having an input coupled to the output of the half-wave rectifier, and an output coupled to the oscillating driver.

8. The lamp circuit of claim 5, wherein the amplitude feedback circuit comprises:

first and second diodes each having an anode end and a cathode end, the anode end of the first diode coupled to GROUND, the cathode end of the first diode coupled to the lamp and to the anode end of the second diode;

a resistor having a first terminal coupled to the cathode end of the second diode and a second terminal coupled to the voltage regulator;

a variable resistor coupled between the cathode end of the second diode and GROUND; and a capacitor coupled between the second terminal of the resistor and GROUND.

9. The lamp circuit of claim 5, wherein the amplitude feedback circuit comprises:

a half-wave rectifier having an input coupled to the lamp, and an output;

a low-pass filter having an input coupled to the output of the half-wave rectifier, and an output coupled to the voltage regulator.

10. The lamp circuit of claim 9, wherein the amplitude feedback circuit comprises a variable resistor having a first terminal coupled to the output of the half-wave rectifier, and a second terminal coupled to GROUND.

11. The lamp circuit of claim 5, wherein the frequency feedback circuit comprises a bandpass filter.

12. The lamp circuit of claim 11, wherein the bandpass filter has a center frequency substantially equal to the resonant frequency of the ceramic transformer.

13. The lamp circuit of claim 5, wherein:

the oscillating driver comprises first and second inputs and first and second outputs, the first and second outputs of the oscillating driver coupled to the first and second inputs, respectively, of the ceramic transformer;

the voltage regulator comprises first and second inputs and first and second outputs, the first input of the voltage regulator coupled to the DC power source, the first and second outputs of the voltage regulator coupled to the first and second inputs, respectively, of the oscillating driver; and the amplitude feedback circuit comprises an input coupled to the lamp and an output coupled to the second input of the voltage regulator.

14. The lamp circuit of claim 13, wherein:

the oscillating driver further comprises a third input; and the frequency feedback circuit comprises an input coupled to the second output of the ceramic transformer and an output coupled to the third input of the oscillating driver.

15. The lamp circuit of claim 14, wherein the frequency feedback circuit comprises:

a bipolar transistor having a collector, a base and an emitter, the emitter coupled to GROUND;

a diode having an anode end coupled to GROUND and a cathode end coupled to the base of the bipolar transistor;

a first resistor coupled between the second output of the ceramic transformer and the base of the bipolar transistor;

a second resistor coupled between a source of DC potential and the collector of the bipolar transistor; and a third resistor coupled between the collector of the bipolar transistor and the third input of the oscillating driver.

16. The lamp circuit of claim 14, wherein the amplitude feedback circuit comprises:

first and second diodes each having an anode end and a cathode end, the anode end of the first diode coupled to GROUND, the cathode end of the first diode coupled to the lamp and to the anode end of the second diode;

a resistor coupled between the cathode end of the second diode and the second input of the voltage regulator;

a variable resistor coupled between the cathode end of the second diode and GROUND; and a capacitor coupled between the second input of the voltage regulator and GROUND.

17. The lamp circuit of claim 14, wherein the oscillating driver further comprises:

a synchronized oscillator having an input coupled to the output of the frequency feedback circuit, and an output;

a driver circuit having an input coupled to the output of the synchronized oscillator, and first and second outputs coupled to the first and second outputs, respectively, of the voltage regulator.

18. The lamp circuit of claim 17, wherein the oscillating driver further comprises:

a first transistor having first, second and third terminals, the first terminal of the first transistor coupled to the first output of the voltage regulator, the second terminal of the first transistor coupled to the first output of the driver circuit, the third terminal of the first transistor coupled to GROUND; and a second transistor having first, second and third terminals, the first terminal of the second transistor coupled to the second output of the voltage regulator, the second terminal of the second transistor coupled to the second output of the driver circuit, the third terminal of the second transistor coupled to GROUND.

19. The lamp circuit of claim 17, wherein the oscillating driver further comprises:

a first transistor having a drain, a gate and a source, the drain of the first transistor coupled to the first output of the voltage regulator, the gate of the first transistor coupled to the first output of the driver circuit, the source of the first transistor coupled to GROUND; and a second transistor having a drain, a gate and a source, the drain of the second transistor coupled to the second output of the voltage regulator, the gate of the second transistor coupled to the second output of the driver circuit, the source of the second transistor coupled to GROUND.

20. The lamp circuit of claim 14, wherein the oscillating driver further comprises:

a high gain circuit having first and second power inputs, an inverting input, a non-inverting input, and an output, the first and second power inputs coupled to the first and second outputs, respectively, of the voltage regulator, the inverting input coupled to a source of DC potential, the non-inverting input coupled to the output of the frequency feedback circuit;

a power stage having an input coupled to the output of the high gain circuit, and an output coupled to the first input of the ceramic transformer; and the second output of the oscillating driver is coupled to GROUND.

21. The lamp circuit of claim 20, wherein the high-gain circuit comprises a comparator.

22. The lamp circuit of claim 20, wherein the high-gain circuit comprises an operational amplifier.

23. The lamp circuit of claim 20, wherein the frequency feedback circuit comprises a bandpass filter.

24. The lamp circuit of claim 23, wherein the bandpass filter has a center frequency substantially equal to the resonant frequency of the ceramic transformer.

* * * * *

UNITED STATES PATENT AND TRADEMARK OFFICE

CERTIFICATE OF CORRECTION

PATENT NO. : 6,087,787
DATED : July 11, 2000
INVENTOR(S) : James M. Williams

It is certified that error appears in the above-identified patent and that said Letters Patent is hereby corrected as shown below:

Column 3,
Lines 9 and 14, change "fosc" to -- $f_{osc}$ --;

Column 6,
Line 48, change "onehalf" to -- one-half --;

Column 8,
Line 20, change "KQ" to -- KΩ --
Line 60, change "VF," to -- $V_{fb}$ --

Column 9,
Line 2, change "transistor 122 Transistor" to -- transistor 122. Transistor --.

Signed and Sealed this

Twenty-third Day of April, 2002

*Attest:*

*Attesting Officer*

JAMES E. ROGAN
*Director of the United States Patent and Trademark Office*